US007484944B2

(12) United States Patent
Kasmer

(10) Patent No.: US 7,484,944 B2
(45) Date of Patent: Feb. 3, 2009

(54) ROTARY VANE PUMP SEAL

(76) Inventor: Thomas E. Kasmer, P.O. Box 779, Johnson City, NY (US) 13790

( * ) Notice: Subject to any disclaimer, the term of this patent is extended or adjusted under 35 U.S.C. 154(b) by 104 days.

(21) Appl. No.: 10/917,046

(22) Filed: Aug. 11, 2004

(65) Prior Publication Data

US 2005/0036897 A1 Feb. 17, 2005

Related U.S. Application Data

(60) Provisional application No. 60/494,327, filed on Aug. 11, 2003.

(51) Int. Cl.
*F01C 1/344* (2006.01)

(52) U.S. Cl. ..... 418/31; 418/156; 418/173; 418/268

(58) Field of Classification Search ..... 418/31, 418/156, 173, 259, 268, 3
See application file for complete search history.

(56) References Cited

U.S. PATENT DOCUMENTS

| | | | | |
|---|---|---|---|---|
| 2,016,315 | A | 10/1935 | Calzoni | |
| 2,564,237 | A * | 8/1951 | Segsworth | 60/491 |
| 2,589,449 | A | 3/1952 | Stageberg | |
| 2,627,650 | A | 2/1953 | Ferris | |
| 2,641,195 | A | 6/1953 | Ferris | |
| 2,641,003 | A | 7/1953 | Ferris | |
| 2,680,348 | A | 6/1954 | Wahlmark | |
| 2,685,255 | A | 8/1954 | Carner | |
| 2,804,016 | A | 8/1957 | Moore | |
| 2,842,064 | A | 7/1958 | Wahlmark | |
| 2,976,698 | A | 3/1961 | Muffly | |
| 3,058,307 | A | 10/1962 | Smith | |
| 3,065,706 | A | 11/1962 | Shoosmith | |
| 3,130,673 | A * | 4/1964 | Finstad | 417/310 |
| 3,130,681 | A | 4/1964 | Fetherston | |
| 3,153,984 | A | 10/1964 | Fiske | |
| 3,162,137 | A | 12/1964 | Carner | |
| 3,166,017 | A | 1/1965 | Marmo | |
| 3,187,676 | A | 6/1965 | Hartman | |
| 3,187,677 | A | 6/1965 | Stieber | |
| 3,190,227 | A | 6/1965 | Davids et al. | |
| 3,361,076 | A | 1/1968 | Davis | |
| 3,452,725 | A | 7/1969 | Kelly | |
| 3,560,118 | A | 2/1971 | Palachik | |
| 3,578,888 | A * | 5/1971 | Adams | 418/133 |
| 3,627,456 | A | 12/1971 | Gerlach | |
| 3,642,387 | A | 2/1972 | Sundberg | |

(Continued)

*Primary Examiner*—Hoang M Nguyen
(74) *Attorney, Agent, or Firm*—L. C. Begin & Associates, PLLC.

(57) ABSTRACT

A rotary vane pump is provided that provides an improved fluid replenishment and pressure relief system within a rotary vane pump system. A system, containing a rotary vane pump containing at least one relief cut between the housing and the rotor, functions to relieve fluid pressure normally found between the housing and the rotor. The fluid leaks from areas such as the rotational clearance required between the rotor and an inner wall of the housing. The system includes a reservoir in fluid communication with the relief cut wherein fluid leaks are then retained within the reservoir. A fluid distribution manifold employing a plurality of check valves, each corresponding to a respective chamber within the rotor, provides a controlled fluid feed from the reservoir to the rotor thereby balancing the fluidic pressure existing between the radially innermost ends of the vanes and the radially outermost ends of the vanes.

5 Claims, 13 Drawing Sheets

U.S. PATENT DOCUMENTS 3,672,796 A 6/1972 Mitchell
3,807,912 A 4/1974 Keller
3,808,814 A 5/1974 Macy, II
3,813,194 A 5/1974 Sholz
3,898,021 A 8/1975 Barneoud-Amoulet
3,960,654 A * 6/1976 Calehuff ..... 162/342
3,995,977 A 12/1976 Takahasi et al.
4,175,398 A 11/1979 Edwards et al.
4,175,399 A 11/1979 Edwards et al.
4,175,400 A 11/1979 Edwards et al.
4,241,591 A 12/1980 Edwards
4,309,152 A * 1/1982 Hagen ..... 417/218
4,325,215 A 4/1982 Yamamoto
4,348,159 A 9/1982 Acheson
4,367,638 A 1/1983 Gray
4,390,328 A 6/1983 Fickelscher
4,414,812 A 11/1983 Parry
4,456,442 A 6/1984 Gnagnetti
4,464,101 A 8/1984 Shibuya
4,470,768 A * 9/1984 Konz ..... 417/310
4,764,095 A 8/1988 Fickelscher
5,216,899 A 6/1993 Fabris
5,239,833 A 8/1993 Fineblum
5,243,822 A 9/1993 Vismara
5,595,067 A 1/1997 Maness
5,642,620 A 7/1997 Bakker
5,901,568 A 5/1999 Haga
5,924,305 A 7/1999 Hill
5,934,076 A 8/1999 Coney
5,961,307 A 10/1999 Key et al.
6,019,168 A 2/2000 Kinnersly
6,022,201 A 2/2000 Kasmer
6,109,040 A 8/2000 Ellison et al.
6,161,381 A 12/2000 Lohrmann
6,195,992 B1 3/2001 Nommensen
6,263,671 B1 7/2001 Bliesner
6,325,140 B1 12/2001 Na et al.
6,336,336 B1 1/2002 Kawaminami et al.
6,336,501 B1 1/2002 Ishikawa et al.
6,338,248 B1 1/2002 Waidner et al.
6,340,052 B1 1/2002 Uehara
6,340,055 B1 1/2002 Yamauchi et al.
6,340,856 B1 1/2002 Schiller
6,341,650 B2 1/2002 Carpentier
6,342,739 B1 1/2002 Furuya et al.
6,343,877 B1 2/2002 Miura et al.
6,345,600 B1 2/2002 Schneider
6,346,810 B2 2/2002 Cho et al.
6,468,044 B1 * 10/2002 Bishop et al. ..... 417/220
6,527,525 B2 * 3/2003 Kasmer ..... 418/31
6,554,596 B1 * 4/2003 Patterson et al. ..... 418/260
6,612,117 B2 9/2003 Kasmer

* cited by examiner

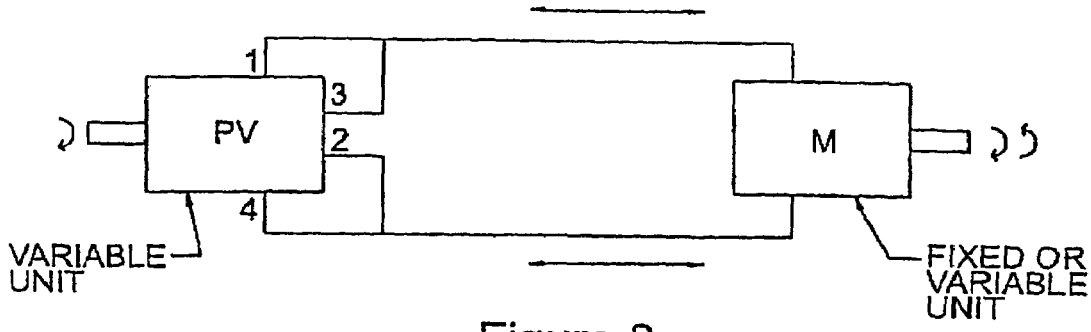
Figure 8
Figure 9
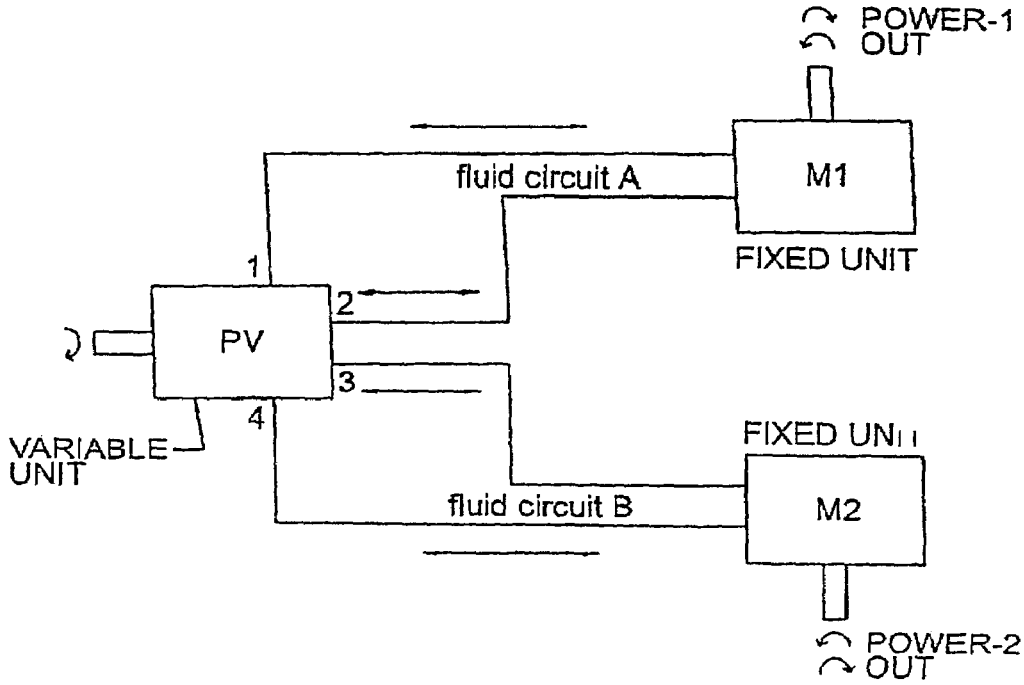

ROTARY VANE PUMP SEAL

CROSS-REFERENCE TO RELATED APPLICATIONS

This application claims the benefit of U.S. Provisional Application No. 60/494,327 filed on Aug. 11, 2003 and herein incorporated by reference in its entirety.

TECHNICAL FIELD

This application relates to rotary vane pumps and specifically to improvements in the sealing, fluid replenishment, and pressure relief of systems incorporating rotary vane pumps. Related co-owned U.S. Pat. Nos. 6,022,201, 6,527,525, and 6,612,117 are herein incorporated by reference in their entirety.

BACKGROUND OF THE INVENTION

Early devices varying the displacement of vane pumps involved the deliberate offset of the rotational center of the vane rotor with respect to the geometrical center of the circular outer case. The amount of offset would then control the swept volume of the pump and thereby provide a desired volumetric output for each rotation of the rotor. Several problems with this design limited its use.

First, the pressure unbalance caused by the hydraulic-based force on the radial cross-section of the rotor and vanes at the axis viewed from the radial perspective severely limited the power capability and power density of these pumps and resulted in very heavy, inefficient, and cumbersome devices. Second, the centrifugal force of each vane during high speed rotation caused severe wear of the vane outer edge and the inner surface of the outer containment housing.

Later fixed displacement designs were conceived around the concept of pressure balance in which two geometrically opposed high pressure chambers would cause a cancellation of radial load due to equal and opposed cross-section pressure areas and opposite vector direction which resulted in a zero net force radially on the shaft bearing. The design is referred to as the pressure balanced vane pump or motor. Typical efficiency of these devices is 70 to 85% under rated loading and speed. Still later improvements included changing the chamber shape of pressure balanced vane style devices and involved the use of several types of adjustable inner surfaces of the outer housing for guiding and radially adjusting the vanes as they rotate. One improvement is a continuous band which is flexible and subject to radial deformation so as to cause displacement control of the vanes. However, these flexible bands did not rotate.

One other concern involves the typical fluid losses that occur during normal operation of rotary vane pumps. The fluid generally accumulates in undesirable areas thereby resulting in pressure buildups that may result in rupture of the pump housing and disabling of the entire pump. An improvement targeted toward reducing the fluid loss and thereby improving the overall efficiency and operability of the system would therefore be welcomed.

SUMMARY OF THE INVENTION

The basic embodiment of this invention is a rotor with spring-biased, radially extensible vanes that are constrained in their outward radial movement, away from the rotor center of rotation, by the inner circumferential area of a continuous flexible band which has the same axial width as the rotor and vanes. It is especially important to notice in the basic embodiment that the flexible band is designed to rotate with the vanes and rotor. The spring loading vanes is by conventional means as is the practice with existing vane pumps and motors; namely that the spring is compressed between the rotor itself and the radially inward edge of the vane so as to drive every vane radially out from the rotor body against the inner area of the flexible band. The spring preload causes the vanes to contact the flexible band inside surface at slow speeds which includes zero. This is especially important if this embodiment is to be used as a variable or fixed displacement hydraulic motor because hydraulic sealing of the vane's outer edge is assured at zero speed. Since the flexible band is totally free to rotate with the vanes and rotor, a very big source of friction, wear, and inefficiency is eliminated due to the teaching of this invention. The well known limitation of the prior art; namely the sliding edge friction associated with the combined outward radial force of the vanes is totally eliminated since there is substantially no relative motion between outside edges of the vanes and the interior constraining surface of the flexible containment band. Further, as the rotor's speed increases, the speed-squared radially outward combined force of the set of vanes is fully contained by the continuity of the flexible band simulating a pressure-vessel type of containment, as if the flexible band were a cross section of a pressure containment cylinder, and the individual radial outward force of the vanes were the pictorial radially outward arrows that are used in drawings to depict the action of the force which is contained. Since the action of the flexible band is to fully contain these combined radial forces of the vanes, there is absolutely no increase of frictional forces due to increasing radial vane force, and this invention solves a very severe limitation of the prior art in that the rotating speed of the fixed devices built according to the prior art is limited to about 4,000 revolutions per minute, while the upper speed limit of the subject invention is substantially higher, say to the range of 30,000 revolutions per minute, governed largely by the design strength and durability of the flexible band. In fact, testing showed that the efficiency of this invention utilizing the rotating components of a commercially available pump having an advertised efficiency of 88% resulted in efficiency measurements of 94.7% when used in combination with the rotating flexible band. The grater efficiency of the instant invention over the prior art will result in much smaller variable pumps and motors in severe applications such as spacecraft. The flexible band design and construction can cover a wide range of variables, from a single circumferentially continuous flexible band to concentric nestings of any practical number of individual circumferentially continuous flexible bands. The smallest circumference band is concentrically nested within a slightly larger second band and the second band is concentrically nested within a still larger inside circumference of a third and yet larger band, and so on, up to the largest outside band whose exterior surface is the exterior surface of the nest and the smaller inner band has its interior surface in contact with the exterior edge of each of the vanes. This construction is similar to the case of a stranded cable of a specific diameter having a much greater strength than a solid rod of the same diameter. Also, the stranded cable is more flexible without failure than the solid rod. The individual clearances between each of the bands in such a collective nest is chosen to allow slippage and lubrication from one band to the next. This nested band-to-band clearance results in a greater efficiency at very high operating speed by allowing a nested concentric set of bands to slip in speed from one concentric member to the next, with the inner band rotating at substantially the same speed as the rotor and the outer bands rotating increasingly slower. The material used to make the endless flexible band can be any appropriate metal, but other appropriate materials, such as plastic, fiberglass, carbon fiber, or KEVLAR.RTM., can be used. This construction material range applies whether a single thickness endless band is constructed, or a concentric nesting of two or more bands is used to make a concentric nesting of a number of bands. The description thus far is of a flexible circular and continuous containment band with the band confining all the radial centrifugal forces of the vanes and eliminating contemporary problems such as sliding vane friction, the speed-squared frictional dependence, and the rotor speed limitation. The flexible band construction will also allow for the shape manipulation of the circumference of the band so as to permit varying the swept chamber volume as the rotor turns.

Reshaping of the flexible band is necessary to control the swept chamber volume of the pump as the rotor is turning and comprises an array of radially movable pistons which are at 0.degree., 90.degree., 180.degree, and 270.degree. around a full circle, i.e. at 12 o'clock, 3 o'clock, 6 o'clock, and also 9 o'clock of a clock face. Each of the pistons has an appropriate curvature to contact the flexible band external surface in the positions cited. If the 12 o'clock and 6 o'clock pistons are caused to move inward, the fixed circumference of the flexible band causes the 3 o'clock and 9 o'clock pistons to move outward by an equal amount. The inward or outward movement of the pistons may be driven by individual controlled hydraulic pressures, or the movement can be caused by mechanical means such as a gear and rack, or radially disposed screw drives to each piston. Another type of piston control means would be the joining of an analog type electric servo motor drive to a ball screw mechanism with an encoder position feedback; which arrangement would easily lend itself to digital control. Whatever the method of controlling the movement of the piston, the final purpose is to controllably elliptasize the flexible band from an axial perspective so as to cause the controlled and varying degrees of swept volume of fluid flow per revolution of the vane pump or motor. In the basic embodiment of this invention, opposing pairs of pistons move simultaneously toward or away from each other, while the remaining set of opposed pistons behave in simultaneous opposition to the action of the first pair. This behavior results in varying degrees of elliptic reshaping of the flexible band viewed from the axial perspective of the vane rotor. A novel and significant aspect of this device is the freedom of movement of the flexible band, which is impossible in the prior art. This includes special manipulation of the pistons and band that allow the combination of this invention to simultaneously manipulate two common fluid, but hydraulically separate, outputs of this device as pump or motor. The variable pressure balanced design has two equal and identical pressure fluid outputs which will be merged so as to drive a hydraulic motor to form what is called a hydrostatic transmission. This is a second embodiment of the present invention. In addition, a second variable vane device of the proposed design may act as a motor in a conventional type of hydrostatic transmission with all of the current results, but with much greater efficiency and range. Another embodiment of the invention is a special piston manipulation which causes this invention to act like the earlier variable non-pressure balanced construction pumps with a single input and output. In the present invention, there is shown two separate hydraulic circuits with separate inputs and outputs where a single pump of the proposed design is separately connected to two fixed displacement hydraulic motors. Motor Number 1 will connect in closed hydrostatic loop with the first and second quadrant ports of the pump, while motor Number 2 will connect in closed hydrostatic loop to the third and fourth quadrants with no interconnection. The plumbing of the motor circuits would be such that both motors would have the correct shaft rotation direction for a anticlockwise example, say forward. If the 12 o'clock and 6 o'clock pistons were directed inward, the 3 o'clock and 9 o'clock pistons would be forced outward with equal hydraulic flow to both motors occurring, causing the motors to turn at the same controlled speed in the forward direction. Now assume that the original circular flexible band shape is modified such that the 3 o'clock piston is moved inward and the 9 o'clock piston is moved outward, while holding the 12 o'clock and 6 o'clock pistons at neutral, the band remaining circular in shape. A first motor connected to the first and second quadrants will reverse shaft direction, with a speed equal to that of a second motor whose direction is still forward. If the 3 o'clock and 9 o'clock pistons were both moved the other way, the second motor would instead reverse rotation in relation to the first motor. Combine this action with the original action of the basic embodiment as described, and one motor can be caused to rotate deliberately and controllably faster than the other motor, such as the case for an axle set of a vehicle going around a turn. Another embodiment of the invention has two separate piston control methods which can be algebraically mixed to effect differential control means of axle rotation for negotiating a turning radius. Another embodiment comprises a fixed displacement motor of the prior art constructed in the manner of this invention, with the piston positions permanently fixed. This arrangement will be much more efficient than conventional hydraulic motors. A still further embodiment is the case of fixed displacement motors and pumps which can greatly improve the efficiency of existing vane pump and motors; namely that one or several flexible bands of the proposed invention construction can be closely fitted to be moveable just inside the fixed elliptic or circular cam ring surface of conventional units, with a small clearance between the flexible ring exterior and the fixed cam ring interior, said clearance supporting an oil film which has minimal friction, while the vane outer edges are now supported by the innermost flexible band's inner surface. This construction provides some of the advantages of the subject invention, such as containment of vane centripetal force, and the replacement of vane-to-fixed cam ring friction with broad oil film friction that is much less, and not speed squared dependent. The primary invention configured as a fixed unit will still be most efficient due to the open chamber between each fixed piston pair. A smaller total oil film in this case will give the least loss. A significant advantage of the just described construction is the ability to fit existing designs, or even retrofit field product without any mechanical change required. Existing vane units could complete with fixed piston pumps and motors in terms of efficiency, but would be less efficient than the basic embodiment. This is a fifth embodiment of the invention.

BRIEF DESCRIPTION OF THE DRAWINGS

FIG. 8 shows a simple schematic connection of the basic embodiment of the invention connected in a closed hydraulic loop together with a conventional hydraulic motor.

FIG. 9 shows a schematic connection of a variable pump connected to two fixed displacement hydraulic motors which drive vehicular wheels.

DETAILED DESCRIPTION

Figure 1:
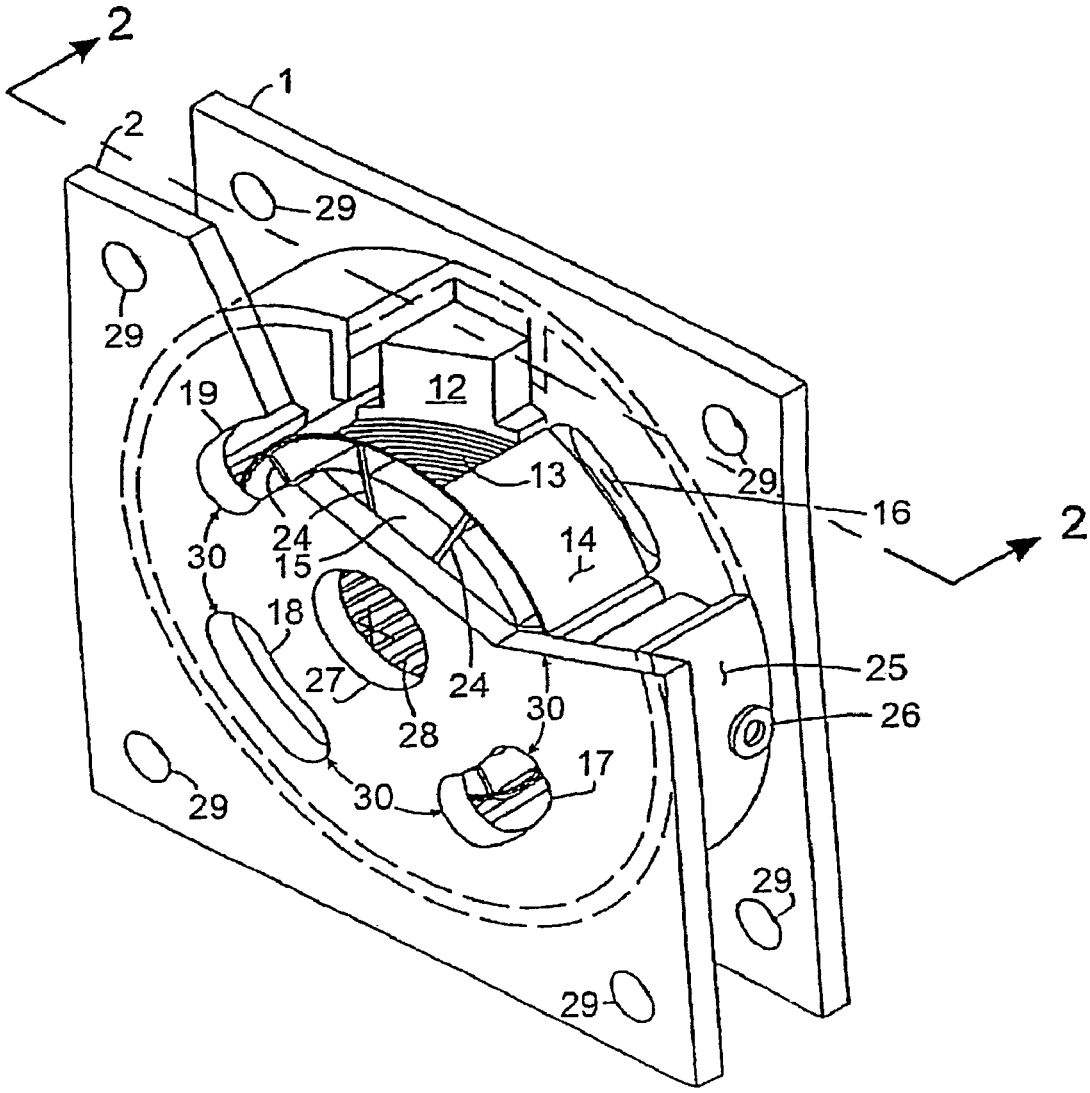
FIG. 1 is an isometric view of the invention with partial frontal cutaway to expose details of construction.

The isometric view shown in FIG. 1 has a frontal first quadrant cutaway which exposes some very important features of the invention. The rear end plate 1 is shown with the first quadrant kidney port 16 exposed. The front end plate 2 is partially cutaway with the kidney ports 17, 18, and 19 respectively in the second, third, and fourth quadrants showing. The rear end plate 1 has like kidney ports 20, 21, and 22 in axial alignment with ports 17, 18, and 19, but those ports in plate 1 are out of view in this drawing. This view shows like kidney ports front and back. However, it is only necessary to have one port per quadrant chamber to allow for fluid flow into and out of the chamber. Either the front or rear ports can be utilized, or both can be used to increase the flow capacity. Also, referring to FIG. 4, any other means of porting which allows fluid to flow into or out of the volume 33, 34, 35, or 36 when they rotate in alignment with "quadrants one, two, two, three, or four" may be used. Front kidney port 23 is in the cutaway portion of end plate 2, and is in axial alignment with port 16. Piston 12 is exposed and is itself cut away at an angle to expose the high pressure fluid film 13 which exists between the curved inner surface of the piston, and the outer circumferential area of the flexible band nest 14. The piston interface shape as shown is curved; however, any surface shape that supports the fluid film 13 can be used. Each of the four pistons has a fluid film 13. Several vanes 24 are exposed by the cutaway. The outer casting 25 has four piston guides and four control ports 26. The ports 26 direct the inlet and exhaust of fluid control pressure to the four pistons to effect reshaping of flexible band 14. The invention is totally symmetric in hydraulic function and can function interchangeably as a hydraulic motor. The front end plate 2 has a hole 27 in it to permit the insertion of a drive shaft that will couple to the rotor 15 by means of the internal splines 28. The drive shaft is not shown so as to minimize the complexity of the figure. Seals and bearings of conventional design are also left out for the same reason. The shaft requires both a seal and bearing in plates 1 and 2 to facilitate the rotation of the rotor 15, the vanes 24. The four holes 29 in each of plates 1 and 2 would allow for four bolts which would tightly hold both of the end plates against the outer casting 25; however, any appropriate number of bolts may be used, and any other means of construction which hydraulically contains the rotor 15, vanes 24, band 14, and shape control means such as the pistons 12, 3, 6, and 9 may also be used.

Figure 2:
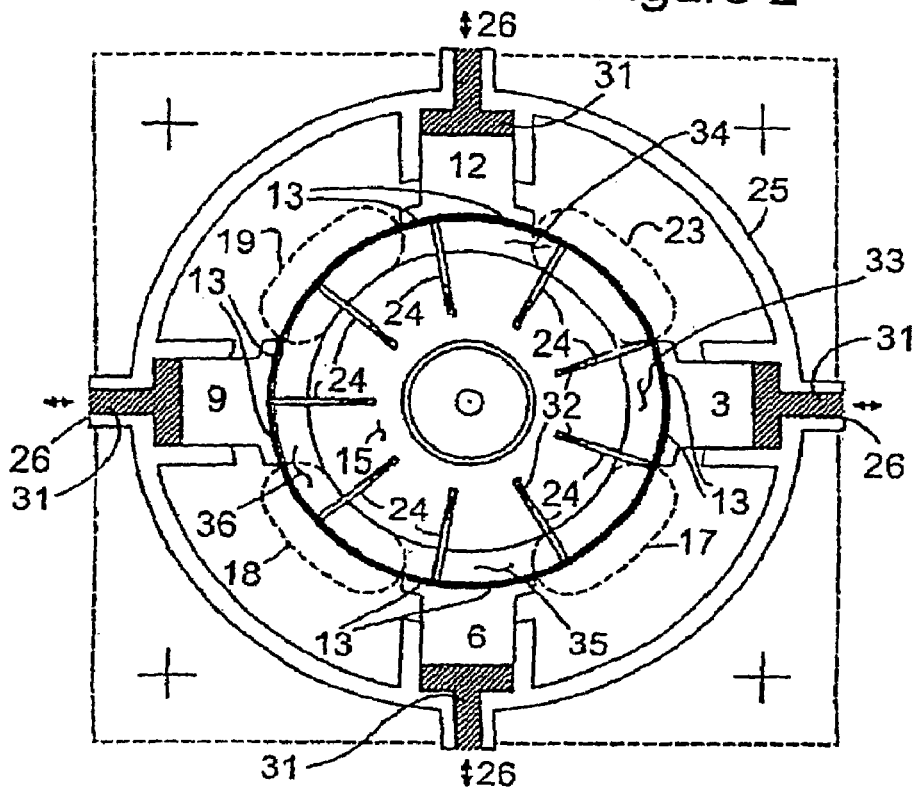
FIG. 2 is an axial view of plane 2-2 of FIG. 1 which shows piston, flexible band, rotor, vanes, and kidney ports.
Figure 3:
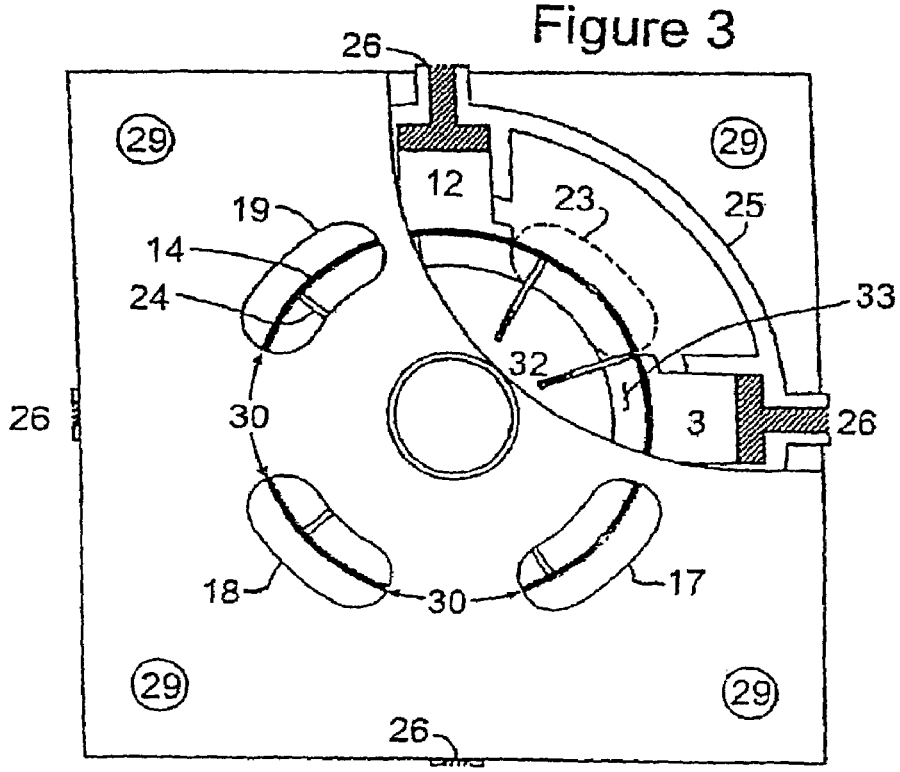
FIG. 3 shows the front plate with kidney ports, with the first quadrant cutaway as in FIG. 1.
Figure 11:
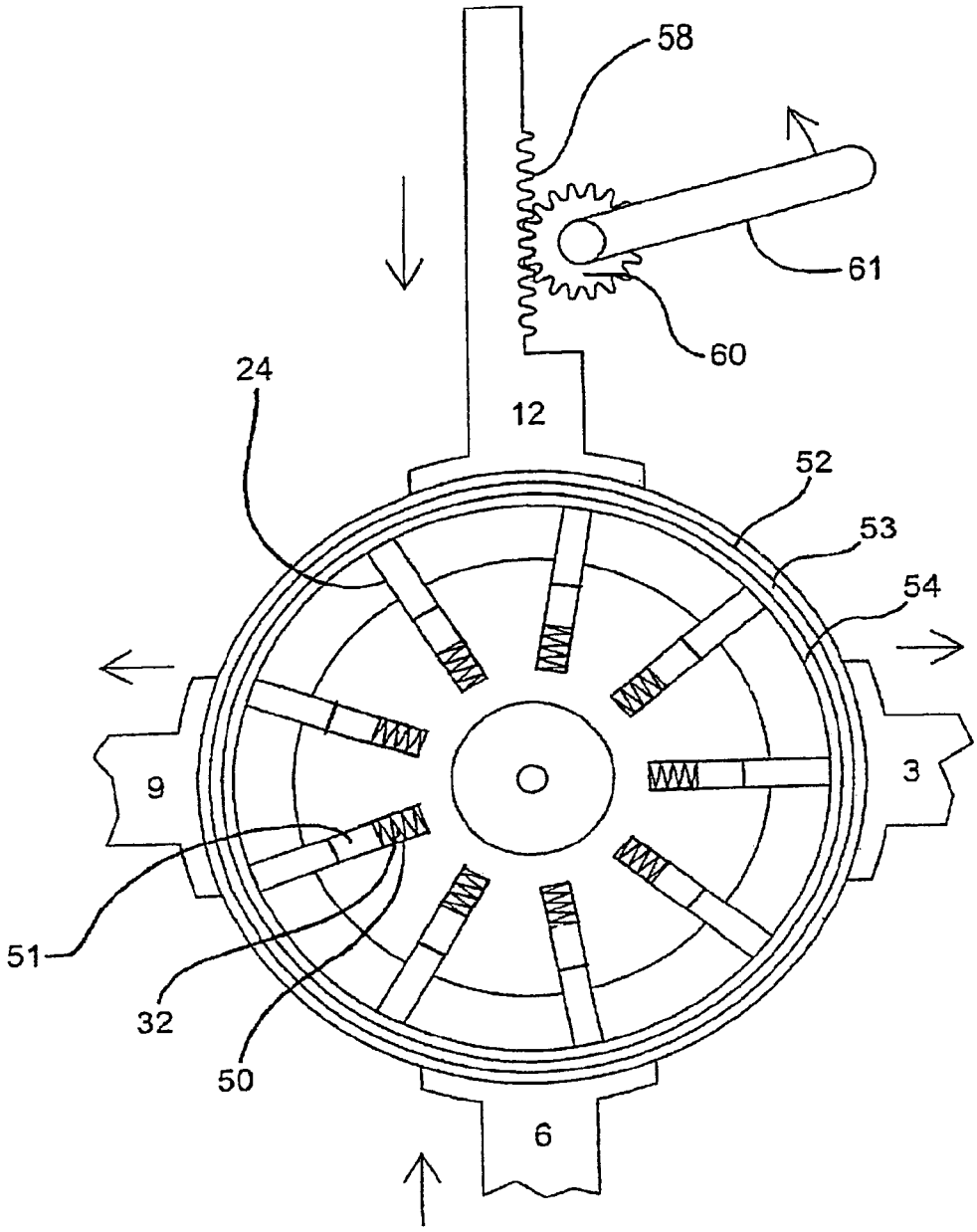
FIG. 11 is a view showing the multilayer flexible band nests and rack and pinion piston drive.

FIG. 2 shows an axial end view of the invention with the end plates removed, and with dotted outlines of end plate 2 with ports 17, 18, 19, and 23 outlined. The four control pistons numbered 12, 3, 6, and 9 are now shown. Shaded areas 31 are filled or exhausted by the control ports 26 to allow control fluid into and out of the chamber 31 behind the four pistons 12, 3, 6 and 9. As shown in FIG. 11, the flexible band 14 had three concentric members 52, 53, and 54. These bands are preferably of stainless steel, each having a thickness in the order of 0.015 inches. The actual number and thickness of bands to be utilized will be determined by the design requirements. Also, as shown in FIG. 11, each vane 24 has compression springs 32 mounted in. rotor 15 that force the vane out from the center of the rotor 15 into contact with the inner surface of the band 14. Three springs and bores are provided for mating with three pins 51 on each vane with the pins being equally spaced along the base of the vane. Such band and spring combinations are found in U.S. Pat No. 4,325,215 which is incorporated by reference herein. This action assures that the vanes will seal fluid pressure at zero speed. It is a very important feature of this invention that the rotor 15, all the vanes 24, and the flexible band 14 will rotate as a group. At very slow speeds, the band will slip very slightly with regards to the vane speed, much like a squirrel cage a.c. induction motor rotor will slip behind the field rotation speed. This slow drift is the result of fluid shear drag caused by the four fluid films 13, which act so as to slow down the flexible band 14 speed. This drag force is counteracted by the combined line contact friction of, in this example, nine vanes. The vane friction is much greater than the fluid film friction, and the vane friction increases as the speed squared. Thus, as the speed of rotation increases, the flexible band will begin to rotate as substantially the same speed as the rotor. Since the vane and band speed never quite equalize, the wear on the inner surface of the flexible band is evenly distributed over the entire inner band surface, and the maximum wear life is achieved. Since the centrifugal, speed squared forces are totally contained by the flexible band, the wear and failure mechanism of high-speed vane type pumps and, motors is eliminated. The added friction of four fluid contact areas 13 is small compared to the combined vane friction, and does not increase significantly with higher speed. The result is a device which is much more efficient than any conventional design and which will operate efficiently at much higher speeds. These factors also allow for quieter operation at higher operating pressure. In FIG. 3, areas of the end plate 2 are marked 30 with identical areas axially in line therewith on end plate 1.

A radial wedge shaped chamber 33 is shown directly under piston 3. Referring to FIG. 2, the front and back aligned areas 30 completely cover the axial ends of the chamber 33. Fluid pressure in quadrants one is prevented from directly flowing into quadrants two, and vice versa. If the rotation of the rotor is clockwise, the volume of chamber 33 will move from quadrant one to quadrant two in one ninth of a revolution. Since the chamber 33 is now closed on both ends by the presence of solid area 30, the volume of chamber 33 which was part of the first quadrant chamber volume is now forced into the second quadrant chamber. Simultaneously, the fluid volume of chamber 34 is rotated from the fourth quadrant chamber into the first quadrant chamber. If the flexible band is formed to a circle, then volume 33 is equal to volume 34, and there is no gain or loss of fluid volume in any of the four quadrant chambers. This is true regardless of speed or direction. If ports 18 and 23 were connected to the inlet port of a separate fixed displacement hydraulic motor, and the motor's return port was connected to device ports 17 and 19, the shape of the flexible band would be called neutral because the pump would not move any fluid into or out of the motor, and the motor shaft would not turn since a fixed displacement of fluid must occur in order for the motor to turn. If ports 23 and 17 were connected to one fixed displacement motor, and ports 18 and 19 were connected to another such motor, the result would be exactly the same. In either case, the input shaft of the variable pump would continue to turn with no motion ever on a motor shaft.

Figure 4:
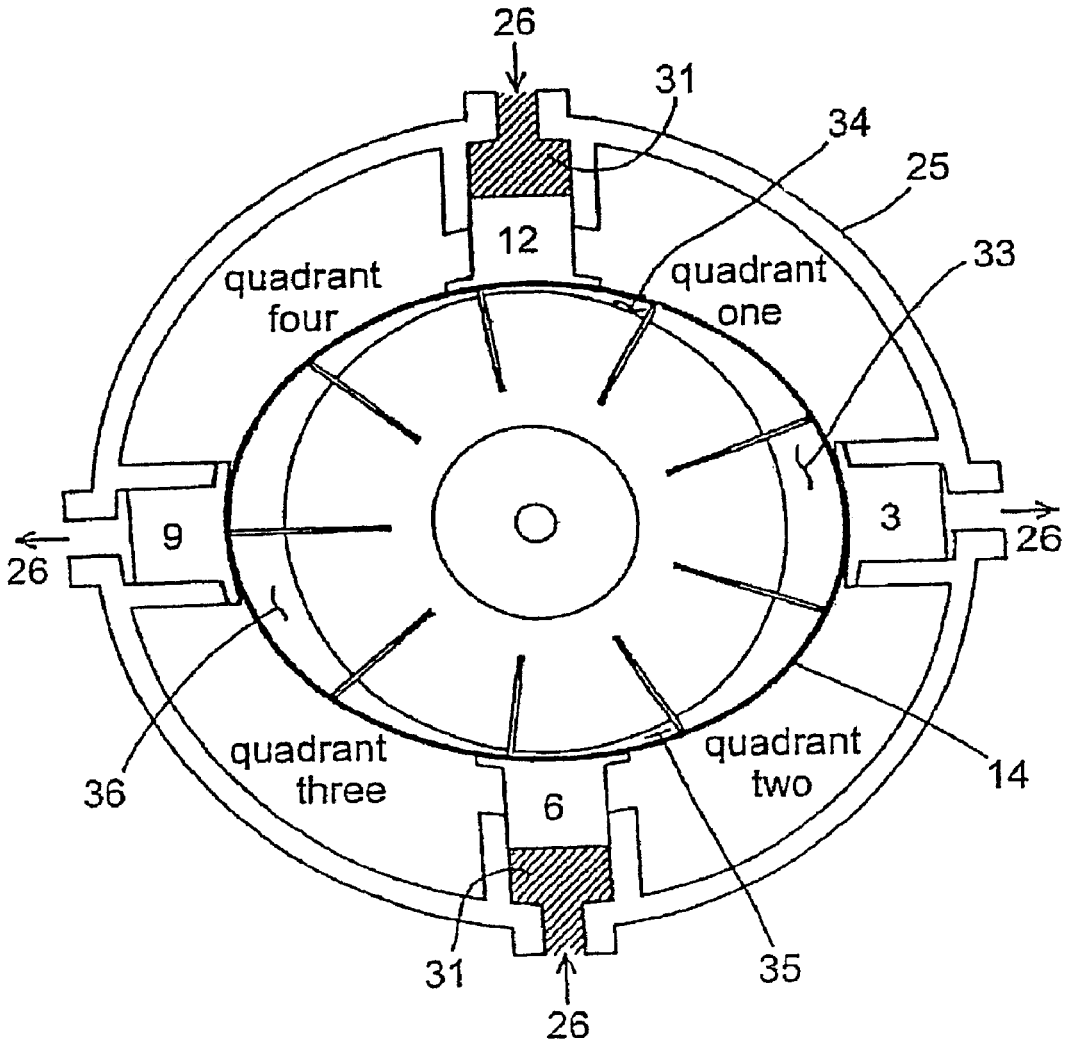
FIG. 4 depicts control pressure being applied to the 12 o'clock and 6 o'clock pistons, causing an elliptical reshaping of the flexible band.

In FIG. 4, control pressure is injected into the control ports 26 for pistons 12 and 6 causing them to move radially inward. Any other mechanical means of control, such as rack 58 and pinion 60 actuable by lever 61 as shown in FIG. 11, would act in a similar manner to the pressure and cause pistons 12 and 6 to move radially inward due to external mechanical force. The spring action of the flexible band causes it to bulge out in equal measure against the pistons 3 and 9, while causing those pistons to move radially outward while exhausting the control fluids volume out through control ports 26. The use of mechanical control here would require that the mechanical controls means would retract to allow for the spring action of the band 14 to push pistons 3 and 9 outward. The arrows at the control ports 26 show the direction of fluid flow. Now for this discussion, a clockwise rotation is chosen. FIG. 4 also shows maximum deflection of the flexible band 14. Rotating vane chambers 34 and 35 are shown as minimized, while the chamber 33 and 36 are maximized. Since chamber 33 is removing a much larger volume of fluid from the first quadrant than the chamber 34 is carrying in, the difference must be provided via either kidney ports 23 or 16. Therefore, ports 23 or 16 are suction ports that can be connected to an external hydraulic circuit, and fluid is drawn into "quadrant one" through those ports. Chamber 33 is very large when it rotates into the second quadrants, and chamber 35 now is very small in exiting. The large difference of the volumes must therefore be forced out kidney ports 17 or 20 into the external hydraulic path. Ports 23 and 16, and 17 and 20 form a hydrostatic loop when connected to an external fixed displacement hydraulic motor. For reference, look at schematic connection in FIG. 9. By varying the radial positions of the pistons 12, 3, 6, and 9, the fluid displaced can be fully controlled from zero to the maximum in any increment. Now, ports 18 and 21, and 19 and 22 will form a second Siamese hydrostatic loop when they are connected to a second external hydraulic motor. For like displacements of the pistons 12 and 6, and opposite and equal motion of pistons 3 and 9, the fluid flow through fluid circuit A which consists of ports 23 and 16, and 17 and 20 will exactly equal the flow through fluid circuit consisting of ports 18 and 21, and 19 and 22. This described the case of straight motion for a set of vehicle axles. The simple case of ports 23 and 16 paired with 18 and 21, and 17 and 30 with 19 and 22, and then connected to a single fixed or variable hydraulic motor is also straight-line motion. For Reference, look at the fluid connection shown in FIG. 8. As the rotor, vane, and flexing band assembly rotate, the action of the elliptasized band will be to force the compression and extension of the vanes 24, with regard to angular position only. The pressure being applied to pistons 12 and 6 through ports 26 causes the pistons to move inward. For the clockwise rotation, output hydraulic pressure will escalate in the second and fourth quadrants chambers. As the chamber pressure increases, an increasing radial outward force develops on the underside of pistons 12 and 6, thereby reducing the respective piston inward force. When the outward force is equal to the inward force, the piston inward motion ceases. As the external hydraulic motor circuit responds to pressure and turns, the developed pressure drops slightly, and allows the pistons 12 and 6 to move slightly more inward, and this in turn increases the volume of fluid passing through the variable pump, in turn causing the motor to turn faster, thus causing a further line drop, causing more piston motion in, and so on. Therefore, the pressure developed in the quadrant chambers is equal to, or in proportion to the control force, and the variable pump automatically changes its displacement to accommodate changing external flow, while holding the out pressure proportional to the control pressure. Thus the hydraulic motor torque is a function of control pressure regardless of variable pump input speed and direction and output motor speed.

Figure 5:
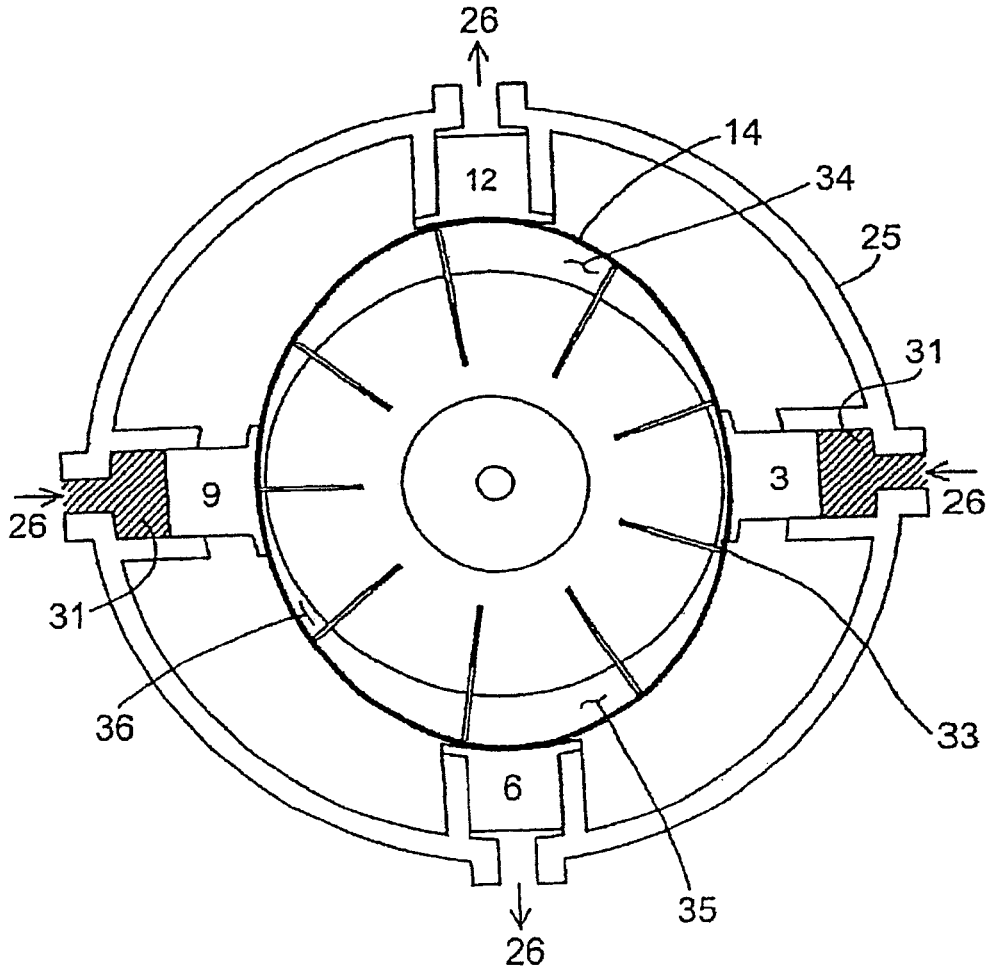
FIG. 5 depicts control pressure being applied to the opposite set of pistons with opposite reshaping behavior.

FIG. 5 depicts the opposite case of piston operation in that pistons 3 and 9 are pressurized, causing them to move radially inward. Pistons 12 and 6 are forced out and the ellipse flexible band major axis is now vertical. Swept chamber volume 34 now is large, as is volume 35, while volumes 33 and 36 are now small. There is now an excess of fluid entering the first and third quadrant chambers and kidney ports 23 and 16, and 18 and 21 become pressure ports, while a shortage of fluid in the second and fourth quadrants results in kidney ports 17 and 20, and 19 and 22 becoming suction ports and the hydraulic motor would now reverse direction. Note that in the case of FIGS. 4 and 5, if the shaft rotation of the pump input were reversed, the external fluid direction would also reverse and the manipulation of the opposed sets of control pistons, both the volume and direction of the fluid output can be fully controlled. Also note that by pressurizing the opposite sets of pistons to the pair shown in FIGS. 4 and 5, the subject pump can be used as a variable hydraulic motor. This is an ideal component for interface between an energy storage flywheel and road wheels. The device as a pump can also interface to a flywheel or electric motor including a pancake design motor and can act to use or recover flywheel or motor energy directly. During acceleration, the pump will withdraw the pre-stored kinetic energy from the flywheel and direct it to the road wheels so as to accelerate a vehicle. During braking, the opposite pistons try to force the flexible band back into a circular shape and in so doing, cause the pump to behave like a motor which then will act to re-accelerate the flywheel to near its initial speed. During the braking action, straight-line vehicle energy is recycled back into the flywheel and the vehicle is brought to a standstill. The braking action is the same for either a single output motor or two motors.

Figure 6:
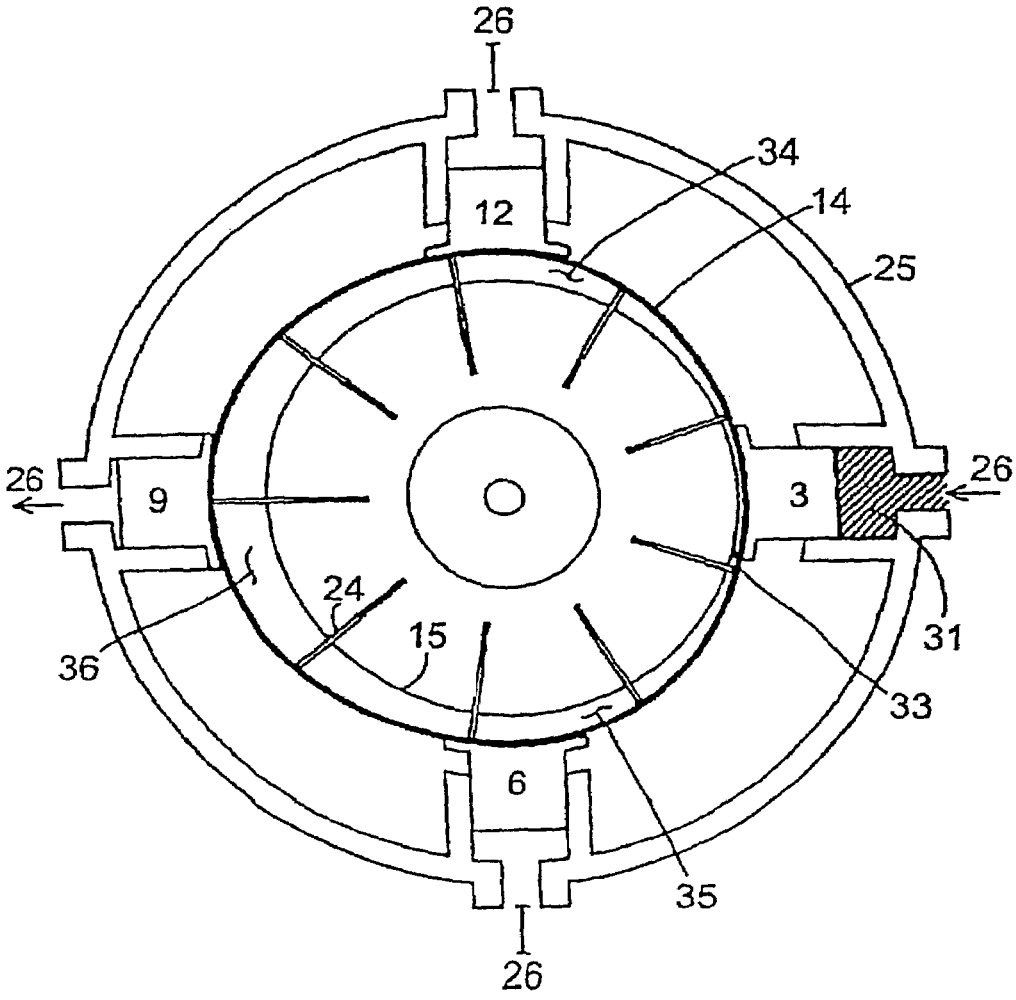
FIG. 6 shows the differential behavior of the invention caused by moving the 3 O'clock and 9 o'clock pistons in the same direction.
Figure 7:
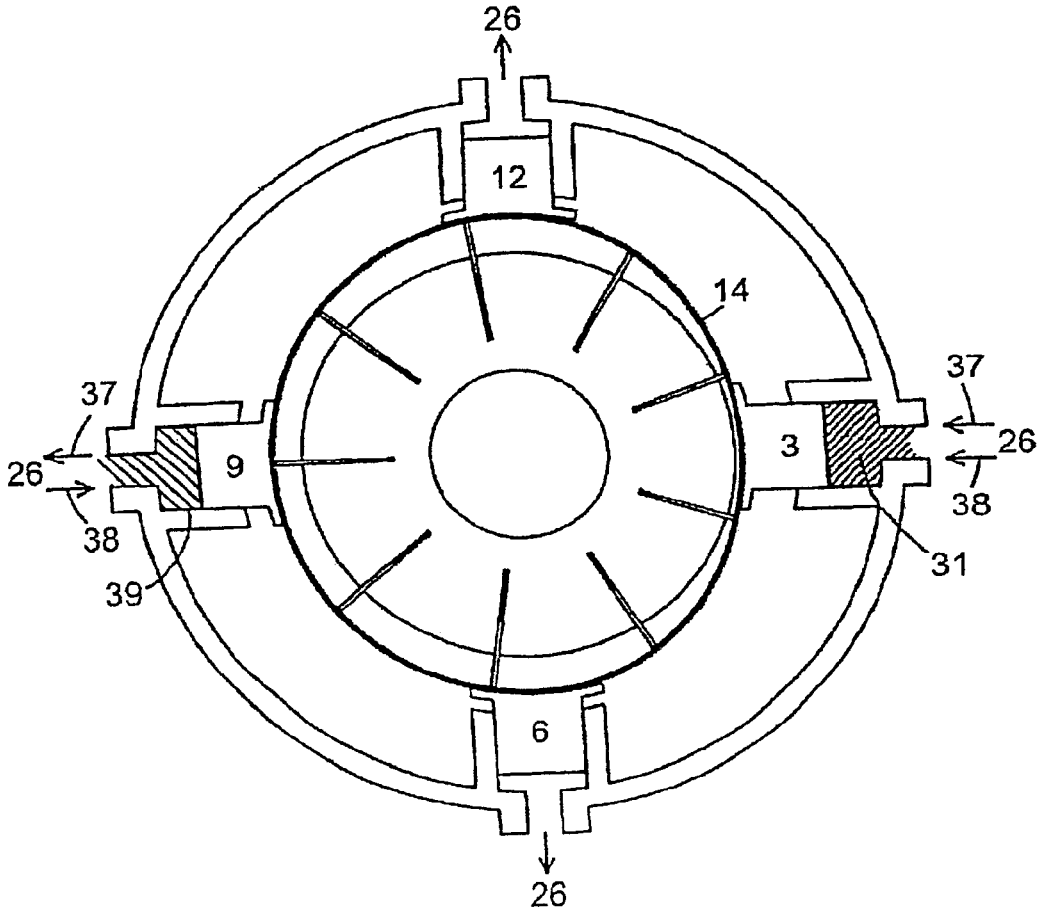
FIG. 7 shows the differential-sum behavior of the invention when more control pressure flow volume is directed to the 3 O'clock control port than is directed to the 9 o'clock port.

FIG. 6 shows control pressure being injected into port 26 causing piston 3 to move inward. Control fluid flows from port 26 of piston 9, and the entire flexible band moves toward piston 9 while maintaining a circular shape. Rotating chambers 34 and 33 behave as in FIG. 5 although with lesser amounts of fluid displacement per revolution. However, if a second motor is connected to ports 18 and 19, as shown in FIG. 9, it would experience a reversal of direction because chamber 36 is now larger than chamber 35, while at the same time, chamber 36 is larger than chamber 34. The third quadrant becomes suction while the fourth quadrant becomes the pressure. This is the behavior of some industrial skid-steer loaders that reverse the rotation of the wheels on one side of the vehicle with respect to the other side, causing the vehicle to spin on its vertical axis. If piston 9 were pressurized instead 3, both fluid circuits would reverse, and the two motors would now spin in opposite directions which are both reverse according to the original directions. During all of the above behavior, note that the control ports 26 of pistons 12 and 6 were quiescent with no inward or outward motion of these pistons. Also, during this differential action, a pressure balance within the pump is no longer maintained, and such differential action should be limited in duration and power level so as to minimize shaft bearing load and therefore maximize pump life. FIG. 7 combines the differential control action with the normal displacement control to achieve special unequal flow to the motors for the purpose of driving two wheels unequally, but correctly around a turn, since the outside wheel rotates faster than the inside wheel. Further, the amount of differential action can be directly related to the correct wheel track in response to a steering input. Thus, a very unique control mechanism is obtained for driving both wheels in turns and this will greatly enhance vehicle traction and safety. In this case, differential control pressure 37 is applied to ports 26 of pistons 3 and 9, while normal control pressure 38 now is simultaneously applied to those same ports. The resultant control pressure 39 and volume obtain at piston 9 may be different from the control pressure and volume obtained 31 applied to piston 3. The result is the combination of circular displacement of the flexible band 14 with reshaping of the band at the same time. The result is a different but controlled speed of one more with respect to a second, as shown in FIG. 9 resulting in a differential two-wheel drive. The differential portion of the control can be derived from the steering system, while the go and stop motion can be derived from brake and acceleration pedals. FIG. 8 shows the variable pump connected to either a fixed displacement hydraulic motor or another variable pump that is used as the motor to form a hydrostatic transmission. The conventional hydraulic motor case is limited to the range of one-to-one and one-to-infinity, where the use of a second variable unit extends the range to infinity to one.

FIG. 9 shows the schematic connection of one variable device to two fixed hydraulic motors, utilizing the Siamese ports of the invention to drive two separate outputs. This connection will allow the differential feature of the invention to be in use to differentially drive the two motors so as to affect a differential drive to the motor outputs, which is the case in a vehicular axle set negotiating a turn.

Figure 10:
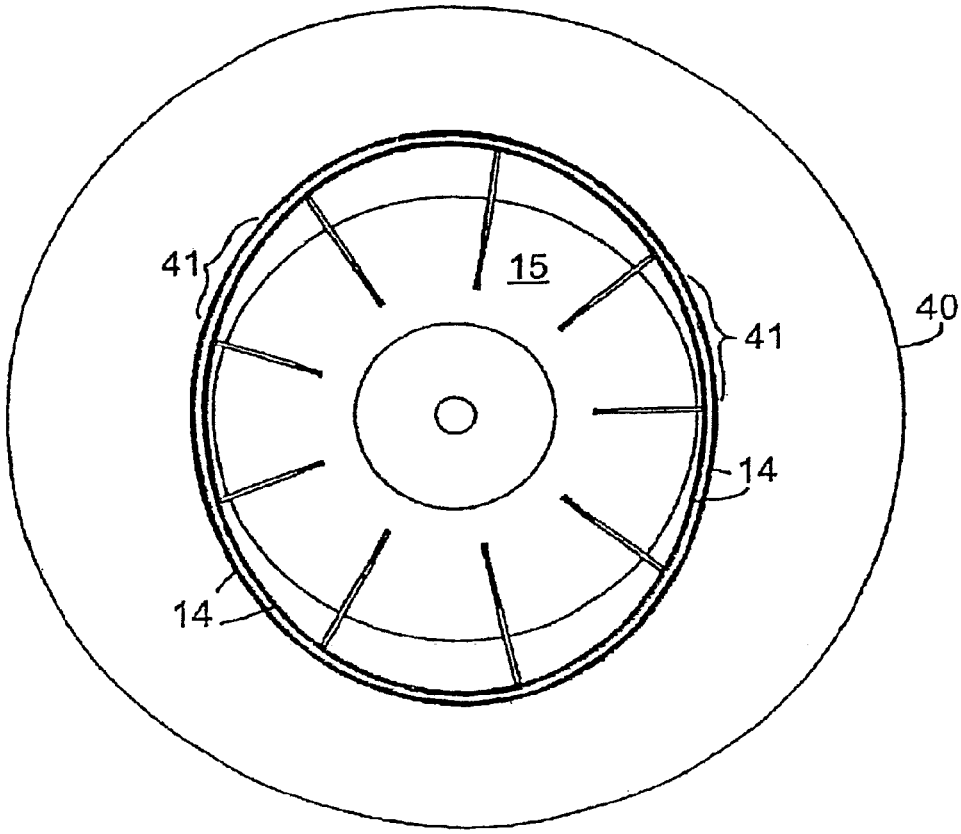
FIG. 10 shows the addition of a flexible band to a conventional fixed displacement vane unit pump or motor with a fixed internal cam ring.

FIG. 10 shows the installation of a flexible band 14 in a conventional vane pump. The vanes 24 and rotor 15 are of conventional construction, like the proposed invention. The outer housing 40 is of conventional manufacture and chamber design, and the oil film 41 separates the band 14 from the outer housing 40 which will reduce operating friction in conventional units. The oil film 41 in this case is the full length of the ground internal chamber of the conventional outer housing. The sliding friction of the set of vanes is eliminated, and replaced by a broad oil film 41 of lesser friction; and, the efficiency of the conventional vane pump or motor is improved. Fixing the piston arrangement shown in FIGS. 4 through 7 will result in a fixed displacement pump or motor, whose efficiency will be the highest of all due to a reduced oil film 41 area.

For referential purposes, all radial orientation described herein is with respect to the axial center of a rotor in accordance with the present invention, unless otherwise stated. Stated another way, "radial" in this context means to emanate to and from the axial center of the cylindrical rotor, unless otherwise stated.

Typically, a rotary vane pump is preferably sealed within an associated housing to provide a sealed system. However, there is a rotational clearance established between the spool of the present invention and the housing that permits leaking of fluid axially outwardly about the flanged peripheries of the spool ends. The fluid then occupies the interface between the housing recesses and the outer surfaces of the spool ends. Without proper relief, the buildup of fluid between the rotor and the inner wall of the housing can lead to rupture of the housing and attendant pump failure.

Figure 17:
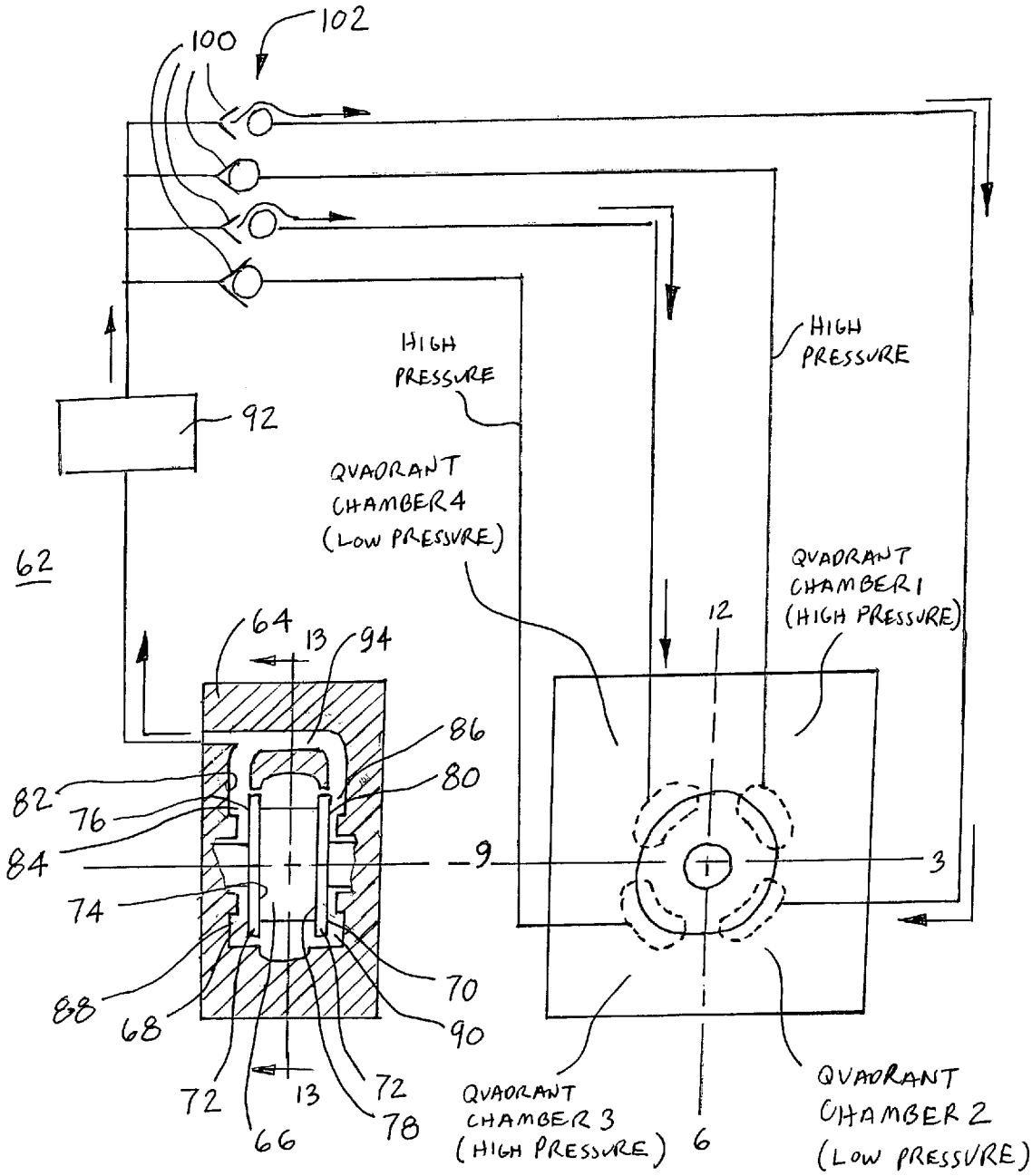
FIG. 17 is a schematic representation of a pump fluid replenishment and pressure relief system in accordance with one embodiment of the present invention.
Figure 18:
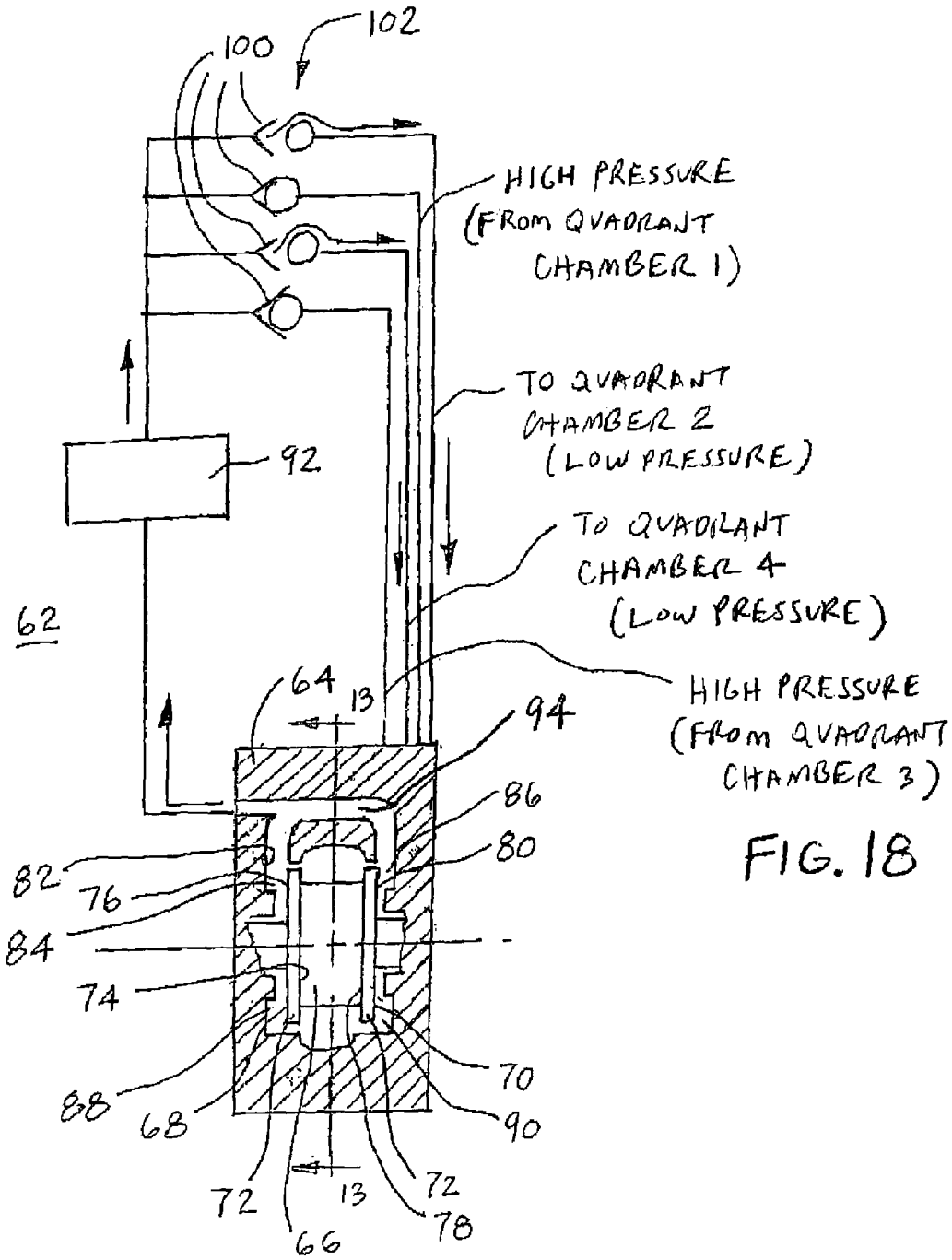
FIG. 18 is the view of FIG. 17 showing a cross-sectional view of the pump and details of the pump fluid replenishment and pressure relief system.

Accordingly, in yet another aspect of the present invention shown in FIGS. 17 and 18, a fluid replenishment and pressure relief system 62 is constructed within and/or about the hydristor or rotary vane pump housing 64. Although a preferred embodiment includes the hydristor rotary vane pump, it should be emphasized that any rotary vane pump may benefit from the following structural design. As described above, a rotary vane pump or hydristor contains a spool 66 for rotation about a central axis thereby facilitating pumping or fluid transfer. Additionally, the pump contains a housing 64 surrounding the spool 66 for containment of the fluids and rotary spool. A first spool end 68 and a second spool end 70 define the ends of the spool 66 and are each preferably configured with flanged portions 72 about the periphery of each respective spool end. The first spool end 68 has a first inner surface 74 facing axially inwardly toward the second spool end 70. The first spool end 68 also has a first outer surface 76 facing axially outwardly, opposite the first inner surface 74. The second spool end 70 has a second inner surface 78 facing axially inwardly toward the first spool end 68. The second spool end 70 also has a second outer surface 80 facing axially outwardly, opposite the second inner surface 78.

Both spool ends are surrounded by the housing 64 wherein the housing 64 contains an inner wall 82 that interfaces with the first and second outer surfaces 76 and 80, respectively, of the first and second spool ends 68 and 70, respectively. In a preferred embodiment, the inner wall 82 of the housing 64 is provided with a first recess 84 that is machined to minimize the rotational clearance of the first spool end 68. Stated another way, the first outer surface 76 is oriented within the first recess 84 while still providing operational rotational clearance. In the same way, the inner wall 82 of the housing 64 is also provided with a second recess 86 on the opposite side of the spool 66, wherein the second recess 86 is also machined to minimize the rotational clearance of the second spool end 70. As such, the second outer surface 80 is oriented within the second recess 86 while still providing operational rotational clearance.

A first relief cut is 88 formed within the inner wall 82 of the housing 64 or within the first outer surface 76 of the first spool end 68, thereby providing a pressure relief cavity between the housing 64 and the first spool end 68. A second relief cut 90 is preferably formed within the inner wall 82 of the housing 64, opposite the first relief cut 88, or within the second outer surface 80 of the second spool end 70, thereby providing a second pressure relief cavity between the housing 64 and the second spool end 70. As shown in the Figures, the relief cuts are preferably formed as circular cuts 360 degrees about the flanged periphery 72 of each spool end.

In further accordance with the present invention, a reservoir 92 is formed within the closed rotary vane pump system 62 whereby the reservoir fluidly communicates with the first and/or second relief cuts 88 and 90, respectively. The Figures show a schematic representation of the reservoir 92 as remote from the rotary vane pump 63. Nevertheless, the reservoir 92 could in fact be formed within the rotor itself or wherever spatially convenient so long as the reservoir 92 is contained within the sealed rotary vane system 63 or more preferably, the hydristor system and does not adversely affect the operability of the rotary vane pump 63. To establish exemplary fluid communication from the relief cut(s) to the reservoir 92, one or more conduits 94 could be formed within the housing 64 to permit drainage of the leaked fluid to the reservoir 92. A fluid distribution manifold 96 contains one or more fluid distribution conduits 98 and fluidly communicates with the reservoir 92, whereby the reservoir 92 is plumbed to the manifold 96 for distribution to the rotary vane chambers as described herein. One or more check valves 100, corresponding in number to the number of fluid distribution conduits 98, are installed within each respective conduit 98 thereby providing a controlled distribution as operating pressures within each respective chamber permit. Stated another way, the operating pressure of each chamber within the rotary vane pump may be constant or may be varied to greater or lesser pressures over a given operating cycle, as described herein. As the pressure in a given chamber decreases, the associated check valve 100 opens thereby facilitating a draw of fluid from the reservoir 92, and thus replenishing the bulk fluid within the system 62. As the pressure in a given chamber increases, the associated check valve 100 closes thereby prohibiting flow into the chamber. In this way, fluid replenishment may be controlled as a parallel function to the pressure differential of the various chambers. In the embodiments shown, four check valves 100 correspond to four chambers thereby providing potential fluid flow to all four chambers as the pressure conditions permit.

Figure 12:
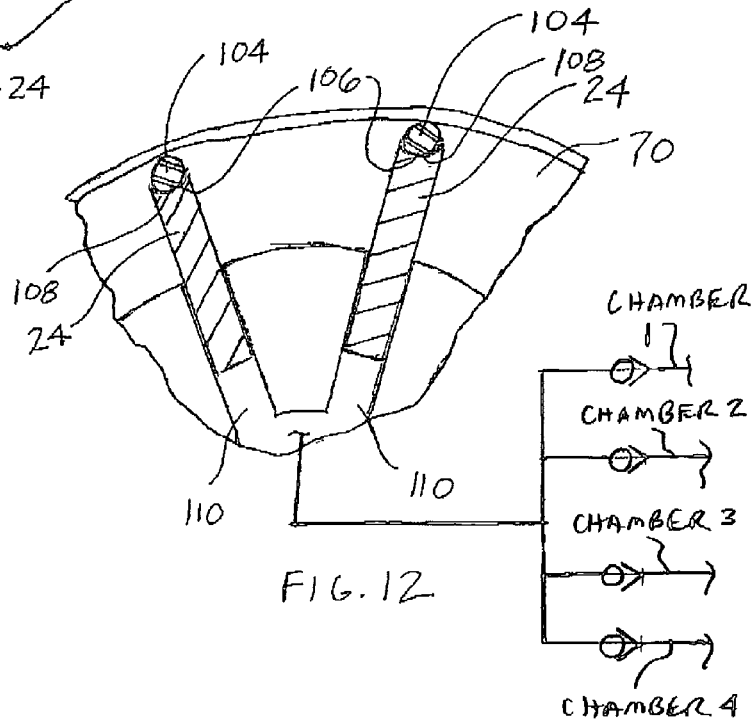
FIG. 12 is a partial cross-sectional view of a pump rotor showing vanes incorporating rubber tips along radial end portions of the vanes, in accordance with one embodiment of the present invention.

As shown in FIG. 12, an entirely separate manifold 96 and ball check system 102 wherein each ball check valve 100 fluidly communicates with one of the four chambers will have effect of selecting the highest pressure of the four chambers and presenting that to the manifold 96 as shown. That highest pressure is then routed to four selective under-vane recesses 50 at each of the four sealing areas 30 under 12, 3, 6, and 9 o'clock. The result is that all of the vanes that are passing through the four sealing areas 30 have the highest chamber pressure directed under forcing the vanes radially outwardly to effectively force the o-ring seal against the underside of the belt, the topside of which is supported by the four respective piston curvatures and the resultant hydrodynamic bearings.

As shown in FIG. 12, another aspect of the invention includes vanes 24 equipped with rubber tips 104 at the radially outermost ends of the vanes. Each vane 24 is equipped with a first rubber tip or edge 104 thereby improving pressure sealing and also increasing friction between the vane 24 and the inside surface of the belt. The rubber may be provided as bulk cord stock. To provide a vane 24 with a rubber tip or edge 104, a vane conduit or channel 106 is machined into the vane 24 that extends from the first spool end 68 to the second spool end 70, and thereby provides a seat for the o-ring or rubber material 104. Or, stated another way, the vane conduit or vane recess 106 is machined to be coextensive in length with the vane. The vane recess 106 is preferably machined with serrations 108 along the length of the hole or conduit 106. This may be done in any known manner. For example, the serrations 108 may be formed by electro discharge machining (EDM) with a wave cut, or, a broach may be employed that zips down the radially outermost edge of the vane and peels metal off. The serrations 108 provide points of friction thereby facilitating a stronger attachment of the rubber therein.

Figure 14:
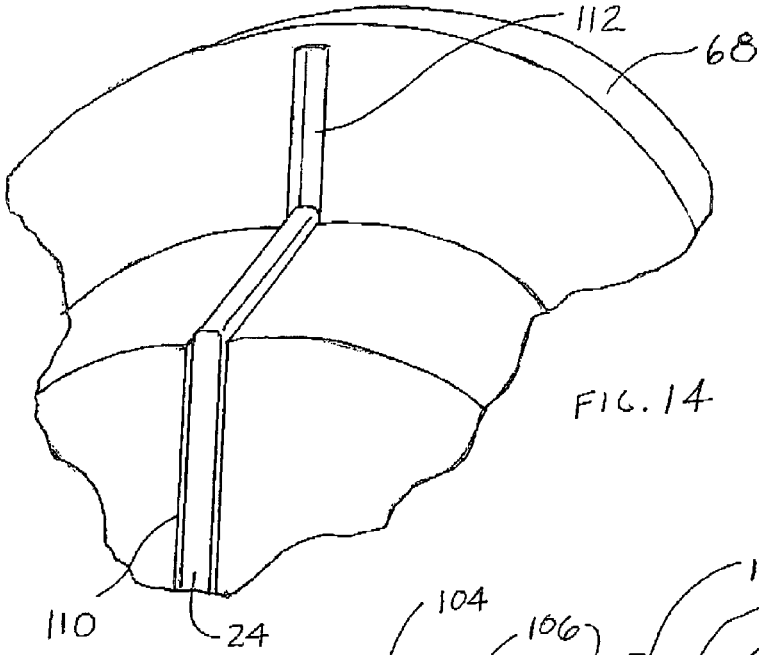
FIG. 14 is an enlarged view of a portion of the rotor shown in FIG. 13 showing an end portion of a vane positioned in a corresponding guide groove.
Figure 13:
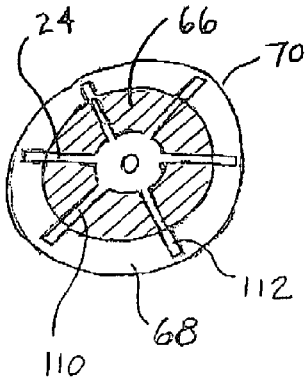
FIG. 13 is a cross-sectional view of a pump rotor showing guide grooves for axial end portions of vanes sliding within slots in the rotor, in accordance with one embodiment of the present invention.

In yet another aspect of the invention, the spool ends may contain grooves that provide a female seat for each respective axial end of each respective vane. U.S. Pat. No. 6,527,525 describes the spool ends of the present invention. FIGS. 13 and 14 illustrate how each vane of the rotary vane pump fits within a slot 110 in the rotor and extends radially outwardly toward the belt. FIG. 13 shows a cross-section of the spool taken along line 13-13 of FIG. 17. The orientation of each vane results in a force biased against the sides of the vane depending on fluid pressure, thereby establishing a cantilevered force on the vane with regard to the vane tips. Accordingly, a first plurality of grooves 112 within the first spool end 68 and a second corresponding plurality of grooves (not shown in FIGS. 13 and 14) within the second spool end 70 provide added mechanical strength and support of the vanes thereby countering the pressures internal to the rotary vane system 62 at each axial end of the vanes. This design also permits a lengthening of the axial length of each vane whereby the extended portions seat within the spool end grooves 112 and 114 with a minimum of sliding clearance. As a result, the vanes can move radially inward and outward with a minimum of fluid bypass loss. Furthermore, the spool end grooves facilitate the use of radially shorter and lighter vanes thereby permitting greater vane extensions and higher operating speeds, or an increase in efficiency and power packaging density. Also, additional o-ring sealing 104 may be incorporated into the vane/spool groove interface as discussed above to further improve sealing.

Figure 15:
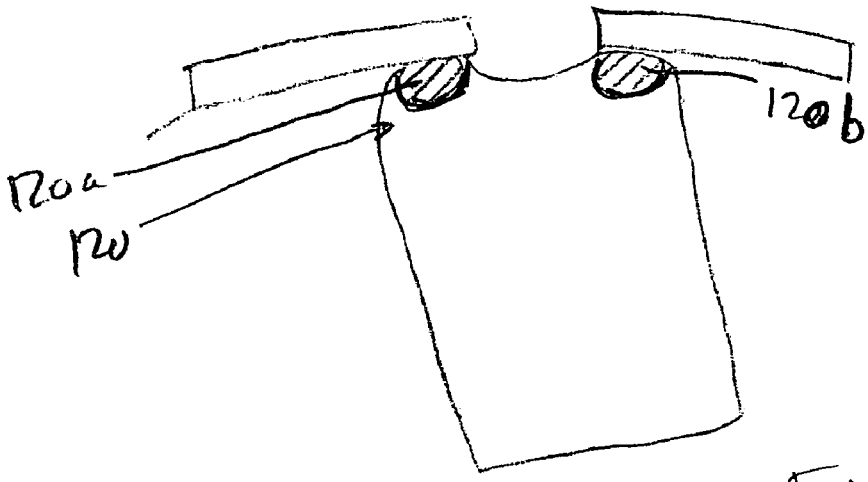
FIG. 15 is a partial cross-sectional view of a vane incorporating a pair of gaskets along a radial edge portion and engaging a perforated belt in accordance with one embodiment of the present invention.
Figure 16:
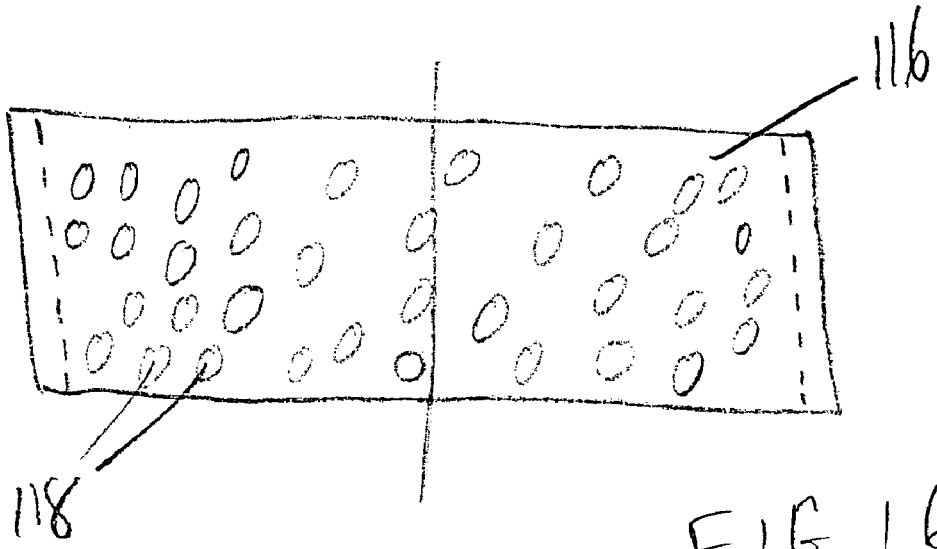
FIG. 16 is a plan view of a portion of a perforated belt in accordance with one embodiment of the present invention.

In still another aspect of the invention, a belt 116 may be perforated across the surface thereof with an array of holes 118 arranged in a random manner so as to maintain the strength of the belt and also to minimize the number of holes aligned with any respective vane tip. The size of the holes are preferably smaller than the thickness of the vane, or, if the size of the holes is designed to be relatively larger, a double o-ring vane tip 120 may be used to facilitate a larger hole size in the belt. FIG. 15 illustrates a relatively larger hole in the belt as it interfaces with a double o-ring vane tip. As shown, each vane tip 120*a* and 120*b* is preferably oriented to reside along the periphery of the hole rather than across it thereby providing localized strength at each hole while still facilitating fluid flow therethrough. FIG. 16 illustrates a perforated belt 116, in accordance with the present invention.

For referential purposes, all radial orientation described herein below is with respect to the axial center of a rotor in accordance with the present invention, unless otherwise stated. Stated another way, "radial" in this context means to emanate to and from the axial center of the cylindrical rotor, unless otherwise stated.

In yet another aspect of the invention, a method of relieving fluidic pressure due to system leaks is provided. At the same time, a method of system fluidic replenishment is provided. The housing or rotor is machined to contain at least one relief cut, and if desired more than one, in either the housing or rotor thereby providing a pressure relief region within the housing. A reservoir is then provided that fluidly communicates with the relief cut(s) for containment of fluid leaked from the rotor/system. A manifold is provided that fluidly communicates with the reservoir whereby the manifold provides controlled bulk fluid replenishment to the rotor thereby maintaining the internal fluid pressure balance existing about the rotor and the vanes. In particular, the fluid is preferably fed to the underside of the vanes thereby maintaining a vane underpressure that prevents bypass of fluid above the vanes. The control may be established by providing a plurality of control check valves corresponding in number to a plurality of chambers within the rotor, the valves responsive to rotor/system pressure within various chambers therein.

In yet another aspect of the invention, a method of enhancing the seal of the chambers and also increasing the friction of the vanes against the belt, rubber tips are inserted along upper longitudinal edges of the vanes. First, the vane has a channel or conduit formed along the upper radial edge of the vane thereby providing a seat for a rubber or o-ring seal. In a preferred embodiment, each vane channel is formed with serrations along its length thereby enhancing the hold of the rubber inserted therein. Then the rubber is inserted within the length.

In yet another aspect of the invention, a method of enhancing fluid transfer from the radially outermost part of the rotor to the outermost part of the belt is provided. First, the belt is perforated with holes having a diameter less than the thickness of the vanes. If desired, the holes may be formed relatively larger in diameter than the thickness of the vanes. If so, then each vane longitudinal edge is preferably formed with two longitudinally and radially extending channels as described immediately above whereby each channel is preferably established along the periphery of the relatively larger hole thereby providing support on each opposing side of the diameter of the hole. Rubber is then inserted therein.

In yet another aspect of the invention, an improved seal of the spool end/vane interface and a stronger vane support are provided. First, a plurality of grooves is formed in the inner wall of each end plate, wherein each groove constitutes a female mating of an axial end of a respective vane. Stated another way, the groove is formed to facilitate a flush fit of the axial end of a respective vane associated therewith, wherein the axial fit extends across the radial length of the vane. The strength of the vanes is enhanced by support at each axial end of the vanes. To improve the seal along the interface between the axial ends of the vanes and the spool ends, o-rings or rubber are assembled along the axial ends of the vanes in the same way that they may optionally be assembled along the radial longitudinal length of the vanes.

As used in the present invention, the term "hydristor" is defined as given above through FIGS. 1-11, and as given in U.S. Pat. No. 6,022,201, incorporated herein by reference. A hydristor is a preferred rotary vane pump to be used in association with the present invention, although the present invention is not thereby limited.

While the foregoing illustrates and describes preferred embodiments of the present invention, it should not be taken to limit the invention as disclosed in certain preferred embodiments herein. Therefore, variations and modifications commensurate with the above teachings and the skill and/or knowledge of the relevant art, are within the scope of the present invention as defined in the appended claims.

What is claimed is:

1. A fluid flow apparatus comprising:

a housing including an outer casing with a longitudinal axis and a plurality of radially extensible vanes within said housing;

means supporting the rotor for rotation about said longitudinal axis relative to the outer casing;

a compressible sealing material secured along a portion of each vane; and a flexible band within said housing surrounding said rotor and positioned so as to engage the sealing material along the portion of the vane, thereby forming a seal between each vane and the flexible band, wherein at least three serrations are formed along the portion of each vane for engaging the compressible sealing material to aid in retaining the sealing material to the portion of the vane.

2. The fluid flow apparatus of claim 1 wherein the compressible sealing material is secured along a radially outermost edge of each vane.

3. The fluid flow apparatus of claim 2 wherein the compressible sealing material is secured within a channel formed along the radially outermost edge of each vane, and wherein the plurality of serrations is formed along the channel to aid in retaining the sealing material within the channel.

4. A rotary vane pump system comprising:

a housing having an interior comprising a plurality of pump chambers;

a fluid replenishment and pressure relief system for relieving excess fluid pressure in an interior of the pump and for recirculating pump fluid, the fluid replenishment and pressure relief system including at least one pressure relief cavity in fluid communication with each pump chamber of the plurality of pump chambers;

a fluid reservoir in fluid communication with the at least one pressure relief cavity, a fluid distribution manifold in fluid communication with the reservoir and with each of the chambers; and a valve positioned along a fluid flow path between each chamber and the manifold for regulating a flow of operating fluid between the manifold and the respective chamber;

a rotor contained within said housing for pumping of fluid, the rotor containing a plurality of slots and a vane residing within each slot of the plurality of slots, each vane extending radially outwardly from the rotor to define a recess within the slot radially inwardly of the vane, each recess being in fluid communication with tire fluid distribution manifold so as to enable supply of fluid from the reservoir to the recess via the manifold, and wherein, upon operation of the rotary vane pump system, fluid flow from the reservoir to a chamber via the manifold is permitted when an internal pressure of the chamber is less than an internal pressure of the reservoir, and fluid flow from a chamber to the manifold is prevented when the internal pressure of the chamber is greater than the internal pressure in the reservoir.

5. The rotary vane pump system of claim 4 further comprising a plurality of pressure relief cavities and wherein at least one conduit is formed within the housing to enable fluid communication between the pressure relief cavities of the plurality of pressure relief cavities.

* * * * *